US008684869B1

(12) United States Patent
Perry

(10) Patent No.: US 8,684,869 B1
(45) Date of Patent: Apr. 1, 2014

(54) ARROWHEAD MECHANICAL BLADE RETENTION SYSTEM

(71) Applicant: Dale W. Perry, Goodyear, AZ (US)

(72) Inventor: Dale W. Perry, Goodyear, AZ (US)

( * ) Notice: Subject to any disclaimer, the term of this patent is extended or adjusted under 35 U.S.C. 154(b) by 0 days.

(21) Appl. No.: 13/738,976

(22) Filed: Jan. 10, 2013

(51) Int. Cl.
*F42B 6/08* (2006.01)

(52) U.S. Cl.
USPC ..... 473/583

(58) Field of Classification Search
USPC ..... 473/583, 584
See application file for complete search history.

(56) References Cited

U.S. PATENT DOCUMENTS

| | | | |
|---|---|---|---|
| 3,036,395 | A | 5/1962 | Nelson |
| 3,138,383 | A | 6/1964 | McKinzie |
| 4,973,060 | A | 11/1990 | Herzing |
| 4,998,738 | A | 3/1991 | Puckett |
| 5,078,407 | A | 1/1992 | Carlston et al. |
| 5,082,292 | A | 1/1992 | Puckett et al. |
| 5,083,798 | A | 1/1992 | Massey |
| 5,100,143 | A | 3/1992 | Puckett |
| 5,112,063 | A | 5/1992 | Puckett |
| 5,178,398 | A | 1/1993 | Eddy |
| 5,286,035 | A | 2/1994 | Ward |
| 5,820,498 | A | 10/1998 | Maleski |
| 5,879,252 | A | 3/1999 | Johnson |
| 5,941,784 | A | 8/1999 | Mizek |
| 6,165,086 | A | 12/2000 | Liechty, II |
| 6,200,237 | B1 | 3/2001 | Barrie |
| 6,270,435 | B1 | 8/2001 | Sodaro |
| 6,322,464 | B1 | 11/2001 | Sestak |
| 6,517,454 | B2 | 2/2003 | Barrie et al. |
| 6,595,881 | B1 | 7/2003 | Grace, Jr. et al. |
| 6,626,776 | B2 | 9/2003 | Barrie et al. |
| 6,669,586 | B2 | 12/2003 | Barrie et al. |
| 6,830,523 | B1 | 12/2004 | Kuhn |
| 6,910,979 | B2 | 6/2005 | Barrie et al. |
| 6,935,976 | B1 | 8/2005 | Grace, Jr. et al. |
| 7,226,375 | B1 | 6/2007 | Sanford |
| 7,713,151 | B2 | 5/2010 | Fulton |
| 7,713,152 | B1 | 5/2010 | Tentler et al. |
| 8,118,694 | B1 | 2/2012 | Oliveira |
| 8,128,521 | B1 | 3/2012 | Ulmer |
| 2010/0173734 | A1 | 7/2010 | Robbins |

*Primary Examiner* — John Ricci
(74) *Attorney, Agent, or Firm* — Albert W. Watkins

(57) ABSTRACT

An arrowhead mechanical blade retention system incorporates retention bumps directly on a pair of opposed deployable blades. When closing or opening the mechanical blades in a broadhead, the retention bumps are forced to pass each other prior to the mechanical blades deploying. This necessarily puts tension on each blade, tending to hold them into position without any additional components. With sufficient force, the blades will simultaneously cross from a closed flight position with a pivot point on one side of the broadhead body to an open and deployed position on the other side of the broadhead body. Once the retention bumps pass each other to release the blades, there is a significantly reduced force required to completely deploy the blades.

5 Claims, 3 Drawing Sheets

ARROWHEAD MECHANICAL BLADE RETENTION SYSTEM

CROSS REFERENCE TO RELATED APPLICATIONS

The present application claims the benefit of U.S. provisional patent application 61/749,898 filed Jan. 7, 2013, the contents which are incorporated herein by reference in entirety.

BACKGROUND OF THE INVENTION

1. Field of the Invention

This invention pertains generally to games using tangible projectiles, and more particularly to an arrow broadhead structure used in archery.

2. Description of the Related Art

Throughout the ages, and even before recorded history, man has devised bows and arrows from readily available materials. Early arrows were likely simple wooden "sticks" or dowels that were sharpened to a point on one end, resembling a small spear. This geometry offers a well-streamlined outline, meaning that there is relatively little air drag. With this geometry, the arrow can travel a relatively greater distance. Unfortunately, the significant distance advantage is offset by a relatively small puncture in the target. Unless struck directly in a vital organ in a way sufficient to cause essentially immediate death, animals such as deer may simply run through a wooded or overgrown area and brush the arrow against the surrounding plants, creating sufficient drag to pull the arrow out. Even if the puncture ultimately proves fatal, the animal may travel a great distance before succumbing. Owing to the small hole and little external blood loss therefrom, the animal may also be difficult or impossible to track. This inability to quickly stop many animals renders these sharpened dowels relatively ineffective, while causing unnecessary suffering and loss.

Later arrows were tipped with sharpened or "chiseled" rock. These stone arrow heads offered a larger, sharper and harder arrow head. Unfortunately, the larger arrow head is also associated with a substantially higher coefficient of drag through the air, meaning the arrow will slow down much more than a sharpened dowel. In addition, the larger and heavier arrow head will also tend to divert he air in flight undesirably. The added drag and the flight diversion both separately and independently reduce the distance from a target for an archer to get a successful shot.

Mankind progressed from the stone age into the bronze age, enabling the production of much thinner and less massive arrow heads. These arrow heads had reduced coefficients of drag when compared to stone, while not sacrificing the size and associated effectiveness of the arrow head. Nevertheless, and still perpetuated today, there are several types of arrow heads in common use.

One type of arrowhead in common use today is the field tip, which has a geometry similar to that of the early sharpened dowel. The tip will typically be an elongate point, generally with an initial taper and a longer body designed to slip over and circumscribe a cylindrical arrow shaft. This tip will typically be metal, ands will ordinarily endure repeated strikes into lesser materials such as straw targets and, in the event of a misfire, dirt and sand. As already noted herein above, the field tip has little utility in the hunting of larger game, but can be useful for smaller animals such as rabbits.

Another common type of arrowhead in common use is the broadhead. This arrow head may have one or more blades that extend radially out from the arrow shaft, meaning that the size of the cut or puncture is greater than would be produced by a sharpened shaft or field tip. This arrowhead is most similar to the stone and bronze arrowheads, but with modern materials is much thinner, meaning less drag during flight, and also much sharper. This combination helps to improve the effectiveness of the arrow, both in effectiveness at quickly stopping the animal and also in improved tracking, since there is a greater likelihood of a blood trail that can be tracked.

Some broadheads have blades that are sharpened in both directions parallel to the longitudinal axis of the arrow shaft, meaning the arrowhead cuts into the target, and also has a cutting surface when being removed therefrom. This bidirectional blade improves the ease of removing the arrowhead from the target, but also means the arrow may be more readily shed by the animal moving through brush and trees.

An additional feature of some modern broadheads is a deployable cutting blade that in flight is aerodynamically configured, most closely resembling the aerodynamic field tip, but which through the force of impact deploys blades that extend radially, gaining the efficacy of a broadhead. As with the fixed broadheads, the cutting blade(s) may be unidirectionally or bidirectionally sharpened, depending upon the archer's preferences. Patents that are exemplary of deployable broadheads, where the arms are moved directly as a result of impact with a target, the teachings and contents which are incorporated herein by reference, include: U.S. Pat. No. 3,036,395 by Nelson, entitled "Releasing fish point"; U.S. Pat. No. 5,078,407 by Carlston et al, entitled "Expandable blade, composite plastic, broadhead hunting arrow tip"; U.S. Pat. No. 5,178,398 by Eddy, entitled "Hunting broadhead for arrows"; U.S. Pat. No. 5,286,035 by Ward, entitled "Archery hunting arrowhead"; U.S. Pat. No. 5,820,498 by Maleski, entitled "Broadhead for an arrow having expanding cutting blades and method of assembling same"; U.S. Pat. No. 5,879,252 by Johnson, entitled "Arrowhead"; U.S. Pat. No. 6,165,086 by Liechty, entitled "Arrowhead with a pivotal blade selectively positionable in a plurality of different cutting diameters"; 6,200,237 by Barrie, entitled "Sliding body expanding broadhead"; U.S. Pat. No. 6,322,464 by Sestak, entitled "Hunting arrowhead with broadhead and extendable blades"; U.S. Pat. No. 6,517,454 by Barrie et al, entitled "Broadhead with sliding, expanding blades"; U.S. Pat. No. 6,626,776 by Barrie et al, entitled "Expandable broadhead with multiple sliding blades"; U.S. Pat. No. 6,669,586 by Barrie et al, entitled "Expanding broadhead"; U.S. Pat. No. 6,830,523 by Kuhn, entitled "Mechanical broadhead arrowhead"; U.S. Pat. No. 6,910,979 by Barrie et al, entitled "Expandable broadhead"; U.S. Pat. No. 6,935,976 by Grace et al, entitled "Mechanical broadhead with sliding blades"; and U.S. Pat. No. 8,128,521 by Ulmer, entitled "Mechanical broadhead with pivoting, interlocking blades".

While somewhat less relevant to the present invention, other artisans have added other apparatus such as masses and gears. Many of the following exemplary patents and published application incorporate such apparatus, and the contents and teachings of each are incorporated herein by reference: U.S. Pat. No. 3,138,383 by McKinzie, entitled "Dual purpose arrow head"; U.S. Pat. No. 4,973,060 by Herzing, entitled "Arrowhead with expandable blades"; U.S. Pat. No. 4,998,738 by Puckett, entitled "Broadhead hunting arrow"; U.S. Pat. No. 5,082,292 by Puckett et al, entitled "Broadhead with deployable cutting blades"; U.S. Pat. No. 5,083,798 by Massey, entitled "Expandable broadhead for an arrow"; U.S. Pat. No. 5,100,143 by Puckett, entitled "Broadhead hunting arrow"; U.S. Pat. No. 5,112,063 by Puckett, entitled "Tubular restraint for broadhead with deployable cutting blades"; U.S.

Pat. No. 5,941,784 by Mizek, entitled "Arrowhead with interchangeable blades"; U.S. Pat. No. 6,270,435 by Sodaro, entitled "Arrowhead"; U.S. Pat. No. 6,595,881 by Grace et al, entitled "Expanding-blade archery broadhead"; U.S. Pat. No. 7,226,375 by Sanford, entitled "Expandable arrow broadhead for attachment to one end of an arrow shaft"; U.S. Pat. No. 7,713,151 by Fulton, entitled "Mechanical broadhead with expandable blades"; U.S. Pat. No. 7,713,152 by Tentler et al, entitled "Arrowhead with unfolding blades"; U.S. Pat. No. 8,118,694 by Oliveira, entitled "Arrow tip with driven deployable retractable blade members"; and US published application 2010/0173734 by Robbins, entitled "Concealed broad head arrow tip and associated methods".

As may be appreciated from the aforementioned patents, many forms of blade retention for deployable broadheads have been used. These typically require the use of additional components such as rubber bands, clips, gears, and other mechanisms and apparatus. These additional components in some cases require the use of consumable materials, such as in the case of rubber bands and the like, and require undesirable extra time to prepare the arrow before and subsequent to flight. Apparatus such as gears and other mechanical mechanisms add undesirable weight and expense. Both consumables and apparatus have a separate chance of failure, meaning a greater likelihood that the arrow will not perform as intended or desired. The extra materials also undesirably increase the cost of using the arrows as well.

The Mizek patent incorporated by reference herein above overcomes many of the deficiencies of the prior art by providing a foil or plate metal member having a pair of raised portions that engage with corresponding recesses within the blades. This combination of raised portions in the foil and recesses in the blades provides a low-force engagement there between, permitting the blades to be retained during flight and deployed with blade-to-target impact. This construction is relatively simpler and more reliable than the prior art consumables and gears and other drive mechanisms. Nevertheless, the formed foil adds significant expense. In addition, the separate formed foils used for each blade can easily become unequal or unbalanced, meaning that the blades do not deploy equally. While this is in most instances inconsequential, if one blade deploys during flight the arrow will be drastically pulled off target. Further, the foil may relatively easily be damaged or deformed during use, again altering the characteristics between the two deployed blades.

In addition to the aforementioned patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is an arrowhead mechanical blade retention system. A bifurcated body defines a channel and terminates at a first end with an arrowhead tip. First and second blades are pivotal within the channel about a pintle from at least a flight position where the first and second blades are generally longitudinally aligned with a longitudinal axis of the bifurcated body to at least a deployed position where the first and second blades are substantially transverse to the longitudinal axis of the bifurcated body. First and second blade bumps are formed in the first and second blades, respectively. The first blade bump is opposed with and interfering with the second blade bump when the first and second blades are operatively set to the flight position and rotated in opposite directions about the pintle from the flight position towards the deployed position, the interference operatively retaining the first and second blades in the flight position.

OBJECTS OF THE INVENTION

Exemplary embodiments of the present invention solve inadequacies of the prior art by providing retention bumps directly on a pair of opposed deployable blades. When closing or opening the mechanical blades in a broadhead designed in accord with the teachings of the present invention, the retention bumps are forced to pass each other prior to the mechanical blades deploying. This necessarily puts tension on each blade, tending to hold them into position without any additional components. With sufficient force, the blades will cross from a closed flight position with a pivot point on one side of the broadhead body to an open and deployed position on the other side of the broadhead body. Once the retention bumps pass each other to release the blades, there is a significantly reduced force required to completely deploy the blades.

A first object of the invention is to hold and deploy blades in a broadhead with the proper amount of tension, permitting the broadhead to in flight perform aerodynamically most similarly to a field tip, while upon impact with a target, being or object performing most similarly to a fixed broadhead and having the benefits and advantages associated therewith. A second object of the invention is to reduce the number of components required for deployable blades, thereby reducing the likelihood of failures or malfunctions, while also lowering the cost of fabrication and durability of the broadhead. Another object of the present invention is to eliminate the need for consumables or special handling prior to or subsequent to flight. A further object of the invention is to simplify the geometry of deployable blades and associated components, thereby reducing the manufacturing costs associated therewith. Yet another object of the present invention is to ensure deployment of both of a pair of opposed and deployable blades simultaneously and with equal force.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
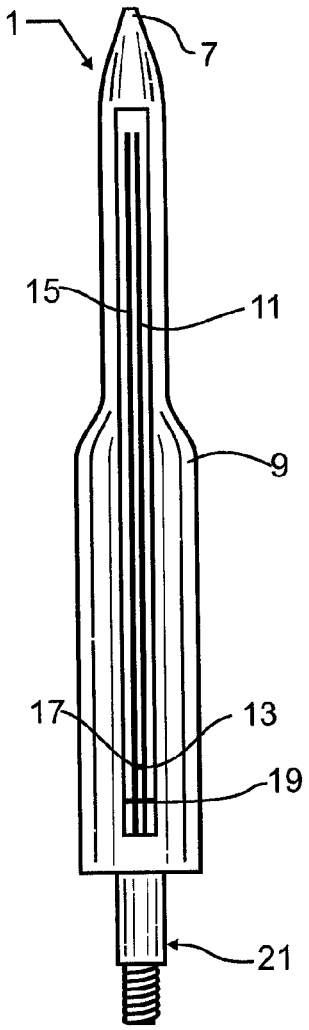
FIG. 1 illustrates a preferred embodiment arrowhead mechanical blade retention system designed in accord with the teachings of the present invention from a side elevational view
Figure 2:
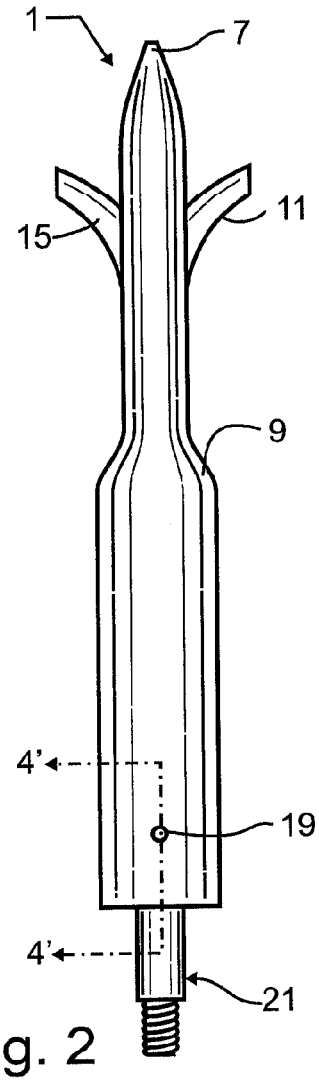
FIG. 2 illustrates the preferred embodiment arrowhead mechanical blade retention system of FIG. 1 from a front elevational view.
Figure 3:
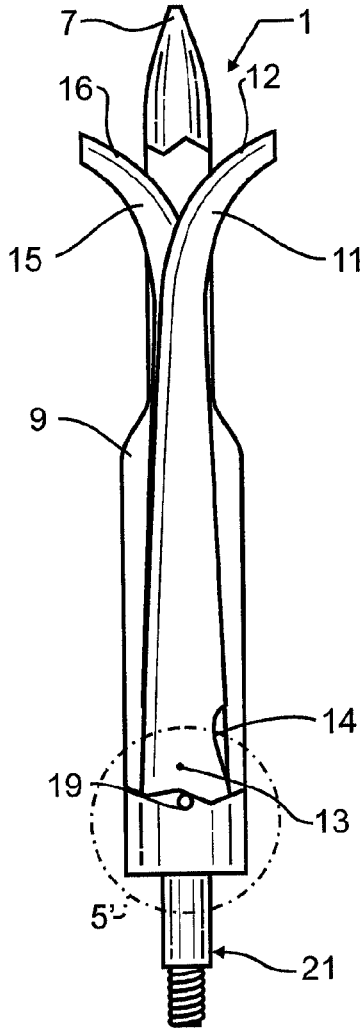
FIG. 3 illustrates the preferred embodiment arrowhead mechanical blade retention system of FIG. 1 from a front elevational view with a partial cut-away to reveal the deployable blades in flight position.

Manifested in the preferred embodiment, the present invention provides an arrowhead mechanical blade retention system that enables a broadhead to in flight perform aerodynamically most similarly to a field tip, while upon impact with a target, being or object perform most similarly to a fixed broadhead, preserving the benefits and advantages associated with each type of arrowhead.

Arrowhead mechanical blade retention system 1 includes a prior art arrowhead tip 7, which may be sharpened to any suitable or desired degree and into any desired shape or geometry. Arrowhead tip 7 terminates opposite the point by adjoining with arrowhead bifurcated body 9, which comprises two sides and a slot there between. Within arrowhead bifurcated body 9 are blades 11, 15 that each have a razor edge 12, 16, respectively, and a blade retention bump/dent 13, 17, respectively, impressed therein. Arrowhead shaft coupler 21 may take any suitable geometry to couple arrowhead mechanical blade retention system 1 to a suitable arrow shaft. In the preferred embodiment, a threaded male post is provided for the purpose.

Figure 4:
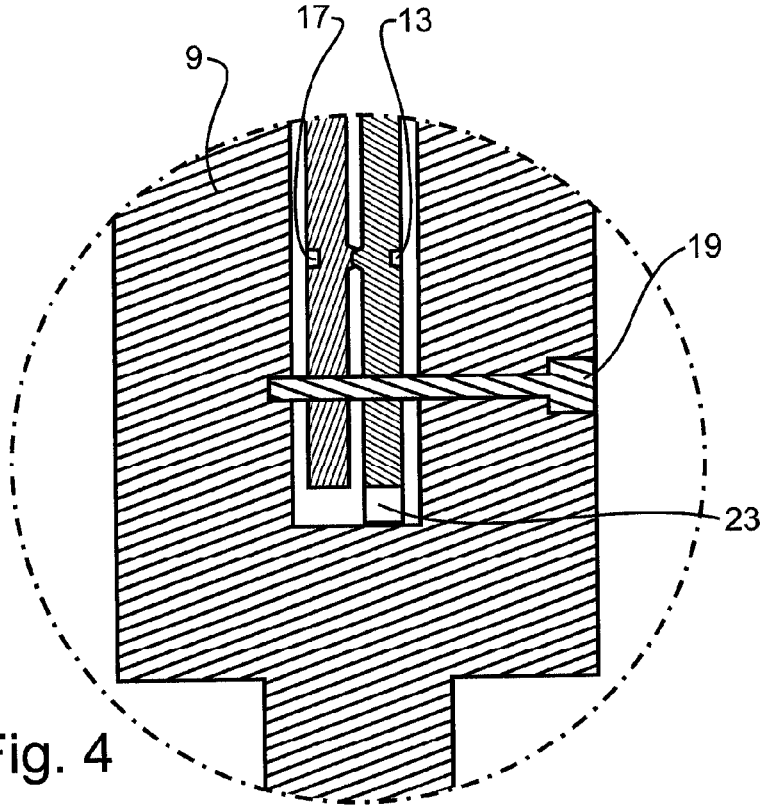
FIG. 4 illustrates the preferred embodiment arrowhead mechanical blade retention system of FIG. 1 from an enlarged sectional view taken along section line 4' shown in FIG. 2.
Figure 5:
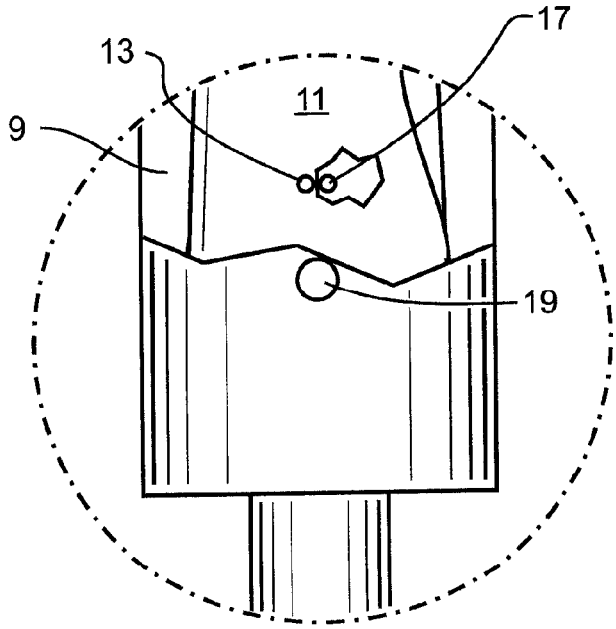
FIG. 5 illustrates the preferred embodiment arrowhead mechanical blade retention system of FIG. 3, including the partial cut-away, by an enlarged view.
Figure 6:
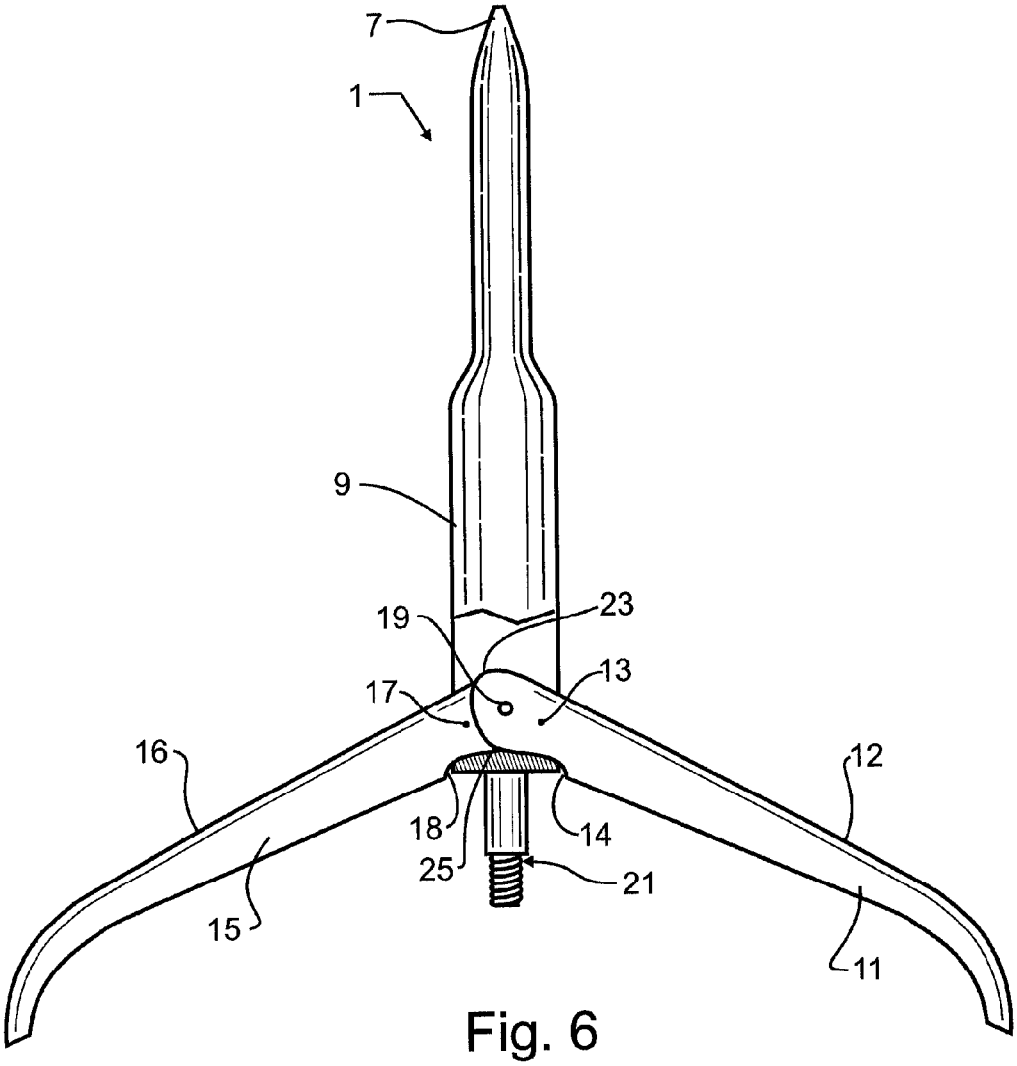
FIG. 6 illustrates the preferred embodiment arrowhead mechanical blade retention system of FIG. 1 from a front elevational view with a partial cut-away to reveal the deployable blades in deployed position.

Blades 11, 15 pivot freely about blade pintle 19, but are limited in angular rotation in the deployed position illustrated in FIG. 6 by blade deployment limiting notches 14, 18, respectively, and are limited in the flight position illustrated in FIGS. 1-5 by the geometry of blades 11, 15 distal from razor edges 12, 16. These stops are identified in FIGS. 4 and 6 for blade 11 as lower edge stop 23 which extends farther from pintle 19 than curved lower edge 25. While not separately illustrated, it will be understood that a like lower edge stop is provided for blade 15. When blades 11, 15 are in the fligh position, these lower edge stops contact and interfere with the bottom of bifurcated body 9, preventing further rotation. In other words, from the perspective of FIG. 6, blade 11 is limited or stopped in clockwise rotation about pintle 19 by blade deployment limiting notch 14 hitting bifurcated body 9 as shown in FIG. 6, and is limited or stopped in counterclockwise rotation about pintle 19 by lower edge stop 23 hitting bifurcated body 9 as shown in FIG. 4. Consequently, as illustrated the preferred embodiment blades 11, 15 are limited to rotation about pintle 19 through an arc of approximately 120 degrees, thought the amount of rotation is readily adjusted and controlled as aforementioned.

As may be understood form the change in position between FIGS. 1-5, which illustrate the flight blade position, and FIG. 6 which illustrates the deployed blade position, the preferred embodiment arrowhead mechanical blade retention system 1 uses a cross-blade design. When closed to the flight blade position, blades 11, 15 reduce wind planning. When open, blades 11, 15 create a greater wound channel.

With the cross-blade design, each blade 11, 15 pivots about pintle 19 from a center point within the arrowhead bifurcated body 9. The lower part of each cross-blade 11, 15 starts on opposite sides of bifurcated body 9. When blades 11, 15 begin to cross to deploy, the retention bumps interfere with each other, creating friction that holds the blades in place. Then when impacting an object/animal at the tip, blades 11, 15 are forced down into the deployed position as illustrated in FIG. 6, overcoming the resistance of the interference between blade retention bumps/dents 13, 17. With the crossing of blades 11, 15, the amount of force needed to force the blades down is greatly reduced from conventional "over the top" blade deployment, resulting in less energy lost and better penetration. The present cross-blade arrowhead mechanical blade retention system 1 is designed to have no extra components that could result in failure or loss of energy.

Each blade 11, 15 is dented to a specific depth as illustrated in FIG. 4 to create a specific blade retention bump 13, 17 on the opposite side of the blade. These bumps 13, 17 create friction by passing each other in an interfering manner as illustrated in FIGS. 4 and 5 when the blades are put into the closed flight position of FIGS. 1-5, thereby holding blades 11, 15 in place until impacting a target or animal. Since the only mechanism is the interference of bumps 13, 17, when one bump releases, so necessarily will the other. This means that the present invention ensures simultaneous blade release, which cannot be ensured in the Mizek patent incorporated herein above by reference. In addition, this unity of action occurs without the need for any additional structure other than the dented blades, which is in stark contrast with the prior art including the Mizek patent, which requires an extra and complex metal foil. The release force required for bumps 13, 17 to cross over each other is determined based upon a variety of factors, including but not limited to the size of the bump in relationship with the thickness of the blade, the size of the opening in the broadhead, and the materials properties of the blades such as tensile strength and resilience or spring constants.

In a contemplated alternative embodiment, and for exemplary purposes only and not solely limiting the present invention thereto, the preferred embodiment illustrated in the figures relies upon the resilience of deployable blades 11, 15 and the size of blade retention bump/dents 13, 17, together with the total size of the channel in bifurcated body 9 to determine and control interference forces. Alternatively, a larger channel is contemplated herein, and a separate spring incorporated co-axially with pintle 19 is contemplated that urges blades 11 and 15 towards each other. In such case, the geometry of blade retention bump/dents 13, 17 and the spring force provided by the pintle-coaxial spring would determine the force necessary for deployment. While less desirable owing to the requirement for an additional spring and the associated potential negative impact on both cost and reliability through the increase in parts count, for certain applications such a construct would be quite viable.

As may be apparent then, while the foregoing details what is felt to be the preferred embodiment of the invention, no material limitations to the scope of the claimed invention are intended. Further, features and design alternatives that would be obvious to one of ordinary skill in the art are considered to be incorporated herein. Consequently, the scope of the invention is set forth and particularly described in the claims herein below.

I claim:

1. An arrowhead mechanical blade retention system, comprising:

a bifurcated body defining a channel and terminating at a first end with an arrowhead tip;

first and second blades pivotal within said channel about a pintle from at least a flight position where said first and second blades are generally longitudinally aligned with a longitudinal axis of said bifurcated body to at least a deployed position where said first and second blades are substantially transverse to said longitudinal axis of said bifurcated body; and first and second blade bumps affixed with said first and second blades, respectively;

said first blade bump opposed with and interfering with said second blade bump when said first and second blades are operatively set to said flight position and rotated in opposite directions about said pintle from said flight position towards said deployed position, said interference operatively retaining said first and second blades in said flight position.

2. The arrowhead mechanical blade retention system of claim 1, further comprising an arrowhead shaft coupler distal to said arrowhead tip and operative to couple said arrowhead mechanical blade retention system to an arrow shaft.

3. The arrowhead mechanical blade retention system of claim 1, further comprising a blade deployment limiting notch that interferes with said bifurcated body to prevent said blades from rotating beyond said blade deployment position when rotating away from said flight position.

4. The arrowhead mechanical blade retention system of claim 1, further comprising a lower edge stop that interferes with said bifurcated body to prevent said blades from rotating beyond said flight position when rotating away from said blade deployment position.

5. The arrowhead mechanical blade retention system of claim 1, wherein said first and second blade bumps are formed unitarily in said first and second blades, respectively.

* * * * *